US008205402B1

(12) United States Patent
diGirolamo et al.

(10) Patent No.: US 8,205,402 B1
(45) **Date of Patent: *Jun. 26, 2012**

(54) STUD SPACER FOR METAL WALL

(75) Inventors: Edward R. diGirolamo, Raleigh, NC (US); Michael Torres, Raleigh, NC (US)

(73) Assignee: The Steel Network, Inc., Durham, NC (US)

( * ) Notice: Subject to any disclaimer, the term of this patent is extended or adjusted under 35 U.S.C. 154(b) by 1900 days.

This patent is subject to a terminal disclaimer.

(21) Appl. No.: 10/682,586

(22) Filed: Oct. 9, 2003

(51) Int. Cl.
*E04H 9/02* (2006.01)
*E04H 9/06* (2006.01)

(52) U.S. Cl. ..... 52/241; 52/242; 52/243; 52/669

(58) Field of Classification Search ..... 52/317, 52/664, 665, 668, 690, 696, 712, 714, 241, 52/242, 243, 667, 669; 403/329; 24/DIG. 38; 292/19, 20, 87; 248/218.4, 57, 546
See application file for complete search history.

(56) References Cited

U.S. PATENT DOCUMENTS

| | | | | | |
|---|---|---|---|---|---|
| 2,994,114 | A | * | 8/1961 | Black | 52/317 |
| 3,334,461 | A | * | 8/1967 | York | 52/317 |
| 3,501,185 | A | * | 3/1970 | Downing, Jr. et al. | 52/664 |
| 3,778,952 | A | * | 12/1973 | Soucy | 52/667 |
| 3,851,435 | A | * | 12/1974 | Roberts et al. | 403/245 |
| 4,237,669 | A | * | 12/1980 | Hunter | 52/417 |
| 4,246,736 | A | * | 1/1981 | Kovar et al. | 52/696 |
| 4,317,641 | A | * | 3/1982 | Sauer | 403/347 |
| 4,361,999 | A | * | 12/1982 | Sidney | 52/696 |
| 4,389,828 | A | * | 6/1983 | Cary | 52/665 |
| 4,499,697 | A | * | 2/1985 | LaLonde | 52/98 |
| 4,535,580 | A | * | 8/1985 | Shirey | 52/506.06 |
| 4,608,801 | A | * | 9/1986 | Green et al. | 52/664 |
| 4,704,829 | A | * | 11/1987 | Baumker, Jr. | 52/127.2 |
| 4,727,703 | A | * | 3/1988 | Platt | 52/664 |
| 4,794,745 | A | * | 1/1989 | Platt et al. | 52/506.07 |
| 4,916,877 | A | * | 4/1990 | Platt | 52/317 |
| 5,044,138 | A | * | 9/1991 | Zaccardelli et al. | 52/667 |
| 5,189,857 | A | * | 3/1993 | Herren et al. | 52/317 |
| 5,386,959 | A | * | 2/1995 | Laughlin et al. | 248/205.1 |
| 5,517,796 | A | * | 5/1996 | Koski et al. | 52/506.07 |
| 5,619,263 | A | * | 4/1997 | Laughlin et al. | 248/343 |
| 5,699,641 | A | * | 12/1997 | Tinen et al. | 52/506.07 |
| 5,884,448 | A | * | 3/1999 | Pellock | 52/643 |
| 5,966,887 | A | * | 10/1999 | Mieyal | 52/506.07 |
| 6,119,784 | A | * | 9/2000 | MacDonald et al. | 169/43 |
| 6,164,028 | A | * | 12/2000 | Hughes | 52/317 |
| 6,189,277 | B1 | * | 2/2001 | Boscamp | 52/317 |
| 6,199,343 | B1 | * | 3/2001 | Sauer et al. | 52/664 |

(Continued)

FOREIGN PATENT DOCUMENTS

| | | | | |
|---|---|---|---|---|
| DE | 93263 | * | 3/1983 | 52/317 |
| GB | 2082647 | * | 3/1982 | 52/317 |
| GB | 2121848 | * | 1/1984 | 52/665 |
| GB | 2147025 | * | 5/1985 | 52/665 |

*Primary Examiner* — Phi Dieu Tran A
(74) *Attorney, Agent, or Firm* — Coats & Bennett, P.L.L.C.

(57) ABSTRACT

A stud spacer for a metal wall having a series of spaced apart studs with each stud having a pair of flanges and an interconnected web with the web having an opening therein. Connected between each pair of consecutive studs is a stud spacer. Each stud spacer includes a pair of end flanges that are secured to the web of an adjacent stud. In addition, each stud spacer includes a projection that projects through an opening in the adjacent stud and extends into an opening or slot in an adjacent stud spacer such that the respective stud spacers are effectively linked or connected by the projections of the various stud spacers found in the metal wall.

5 Claims, 8 Drawing Sheets

U.S. PATENT DOCUMENTS 6,253,529 B1 * 7/2001 De Boer ..... 52/763
6,260,318 B1 * 7/2001 Herren ..... 52/317
6,286,265 B1 * 9/2001 Rinderer ..... 52/28
6,305,139 B1 * 10/2001 Sauer ..... 52/506.07
6,705,056 B2 * 3/2004 Tollenaar ..... 52/317
6,729,100 B2 * 5/2004 Koski et al. ..... 52/726.2
6,765,146 B1 * 7/2004 Gerardo ..... 174/58

* cited by examiner

STUD SPACER FOR METAL WALL

FIELD OF THE INVENTION

The present invention relates to metal stud wall structures, and more particularly to a stud spacer adapted to be interconnected between respective studs forming a part of the wall structure.

BACKGROUND OF THE INVENTION

Metal studs are commonly used to form wall structures that can be load bearing or non-load bearing. Typically such wall structures include a plurality of metal studs connected between upper and lower metal tracks. Generally, the lower track is secured to a floor structure while the upper track is generally connected to an overhead structure. Wallboards and other types of interior wall materials can be secured to the sides of the studs. Metal wall structures are designed to withstand a variety of loads. For example, there can be load bearing loads imposed on the studs of the wall structure from an overhead load. Further, wall structures may be designed to withstand non-load bearing conditions such as wind and seismic loads. In any event, these load bearing and non-load bearing forces will generally act as vertical and horizontal loads on the wall studs. These loads, in some cases, can result in damage to the studs and the finishes secured to the studs if the wall structure is not properly braced.

This problem has been addressed in the past by providing lateral structural bracing to support the studs in the weak direction. Generally, such lateral structural bracing is secured to one side of the stud wall and directly to the studs and extends diagonally across the studs. However, such bracing structures are relatively expensive and require significant labor to install.

In other cases, it is known to include spacer bars extending through openings formed in the studs. However, many spacer bar designs are difficult to install and in the end do not yield substantial strength and rigidity.

Therefore, there has been and continues to be a need for a stud spacer system that is easy to install and which provides substantial strength and rigidity to the wall structure comprising the studs and which effectively aids the studs in withstanding both load bearing and non-load bearing forces.

SUMMARY OF THE INVENTION

The present invention relates to a stud spacer for a metal wall including a plurality of spaced apart studs with each stud including an opening therein. Respective stud spacers are interconnected between consecutive studs. In one embodiment, each stud spacer is secured to the web of an adjacent stud. Further, each stud spacer is provided with a projection or tab that extends through an opening in the adjacent stud and links to or connects to an adjacent stud spacer. Therefore, in this embodiment, the respective stud spacers are both interconnected between respective studs and linked by a linking or connecting structure that extends through openings within the studs.

In a particular embodiment, each stud spacer of the present invention is provided with a pair of opposed connecting flanges that are adapted to be secured directly to the web of two spaced apart studs. In addition, each stud spacer includes a projection or tab that extends through an opening of an adjacent stud and into an opening or slot formed in an adjacent stud spacer. The engagement of the projection of one stud spacer with the opening or slot of another stud spacer effectively links or couples the respective stud spacers together while the stud spacers are fastened or otherwise secured to the studs.

Another aspect of the present invention entails a method for forming a metal stud wall. A series of studs are positioned in spaced apart relationship and a series of stud spacers are secured within the wall with each stud spacer being disposed between two consecutive studs. Each stud spacer is fastened or secured to opposed studs. In addition, the stud spacers are linked or connected together by extending a projection or a tab from one stud spacer, through an opening in an adjacent stud, and into an opening or receiving area formed on an adjacent stud spacer. Thus, the formed metal wall includes a series of stud spacers connected between respective studs and linked or connected by a structure that extends from one stud spacer through an opening within an adjacent stud into engagement with an adjacent stud spacer.

Other objects and advantages of the present invention will become apparent and obvious from a study of the following description and the accompanying drawings, which are merely illustrative of such invention.

DESCRIPTION OF EXEMPLARY EMBODIMENT

Figure 1:
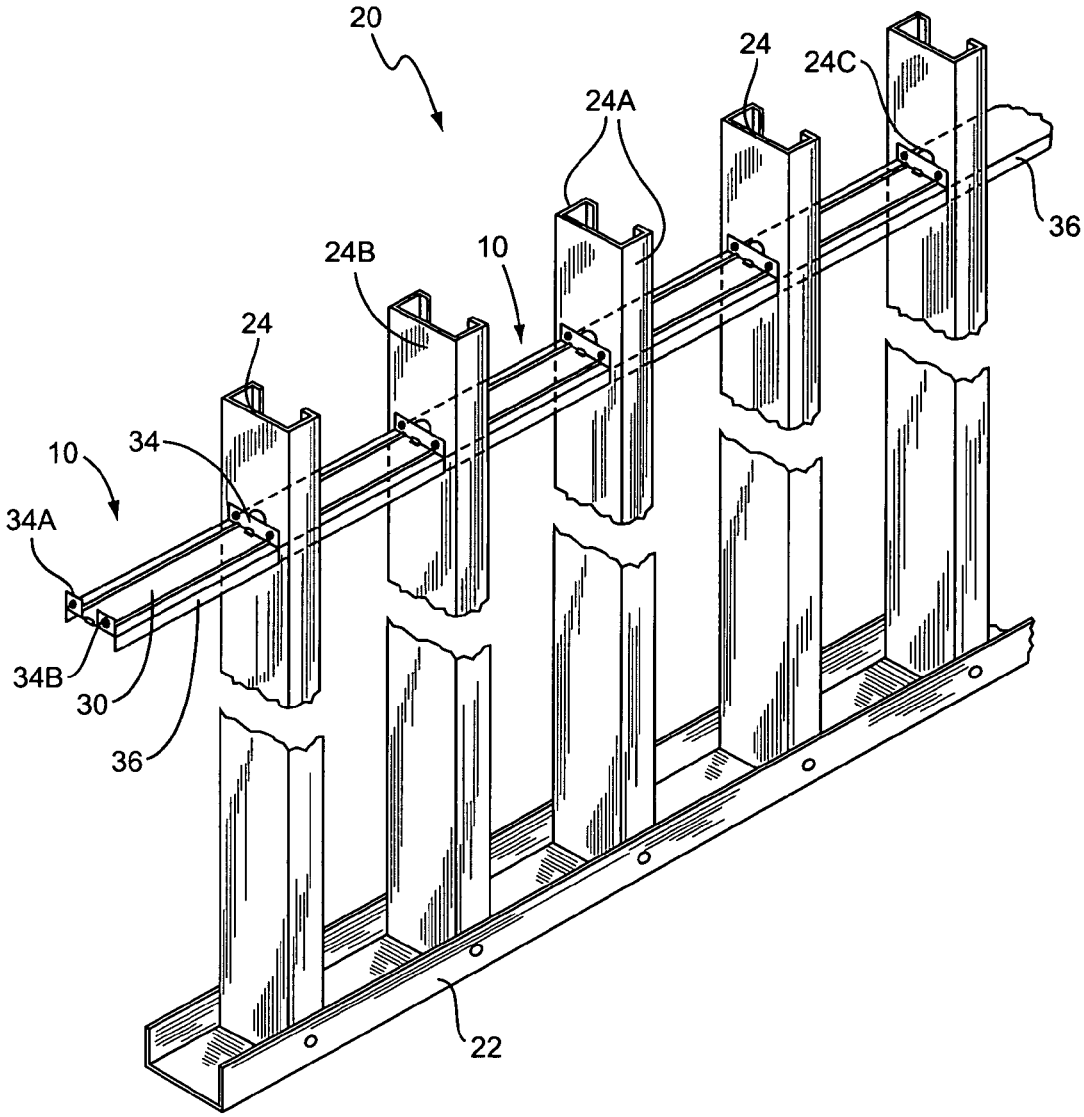
FIG. 1 is a perspective view of a metal wall section having the stud spacers of the present invention incorporated therein.

With further reference to the drawings, the stud spacer of the present invention is shown therein and indicated generally by the numeral 10. In FIG. 1 there is shown a wall section indicated generally by the numeral 20. Wall section 20 includes a series of the stud spacers 10. Before discussing the manner in which the stud spacers 10 are incorporated into the wall section 20, it will be beneficial to review the construction of the stud spacer itself.

Turning to FIGS. 1A-5, the stud spacer 10 is shown therein and includes a central section 30. Central section 30 extends between a pair of end flanges 34. Forming a part of the central section 30 is a pair of longitudinal ribs 32. Ribs 32 are formed in the central section 30 of the stud spacer 10 by any conventional means and once formed in the central section, the ribs 32 impart strength to the central section and to the overall stud spacer 10.

Figure 1A:
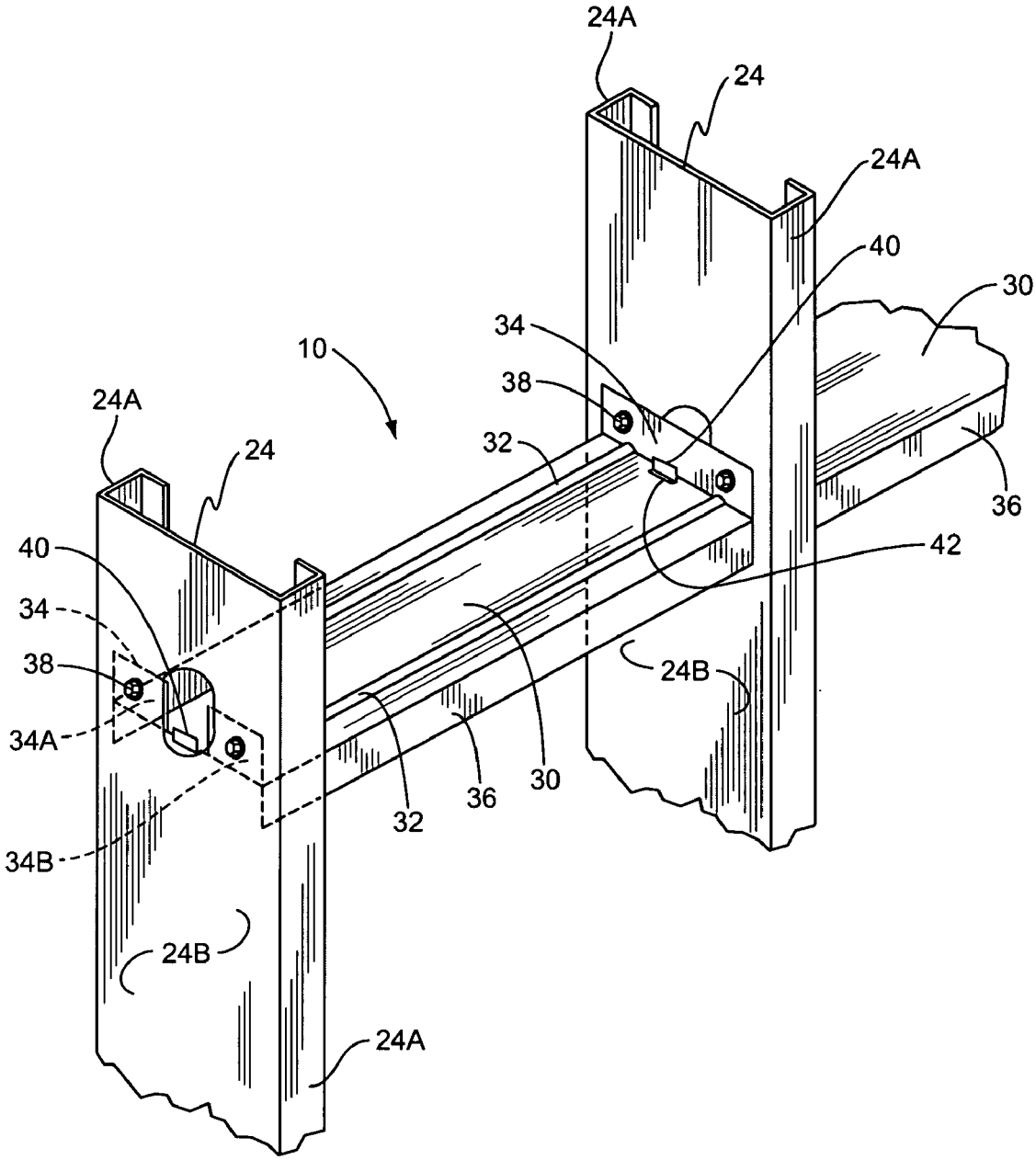
FIG. 1A is a fragmentary perspective view showing one stud spacer extending between two studs and a second stud spacer extending away from one of the studs.
Figure 2:
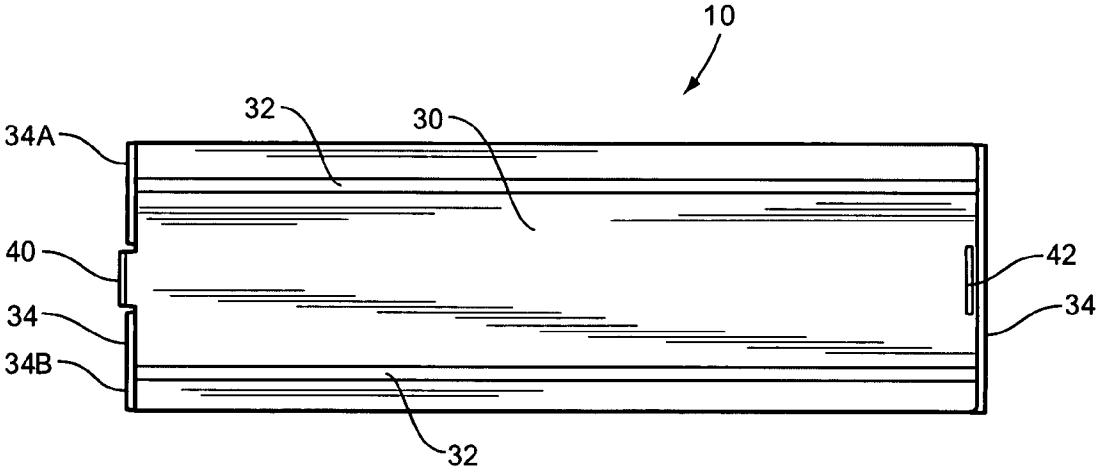
FIG. 2 is a plan view of the stud spacer.
Figure 5:
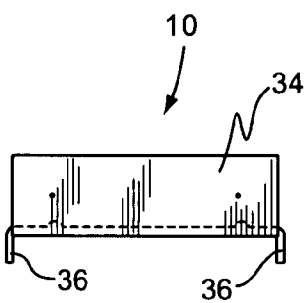
FIG. 5 is an end elevational view of the stud spacer illustrating the end opposite that shown in FIG. 3.
Figure 4:
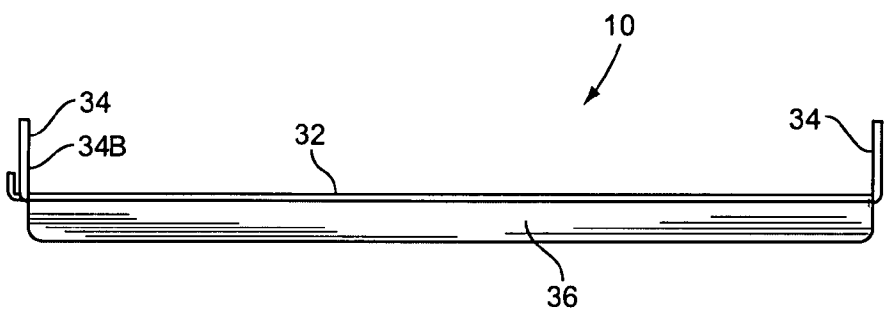
FIG. 4 is a side elevational view of the stud spacer.
Figure 3:
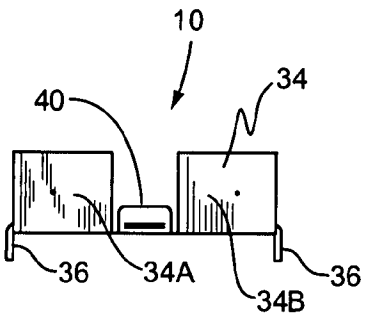
FIG. 3 is a front elevational view of the stud spacer.
Figure 6:
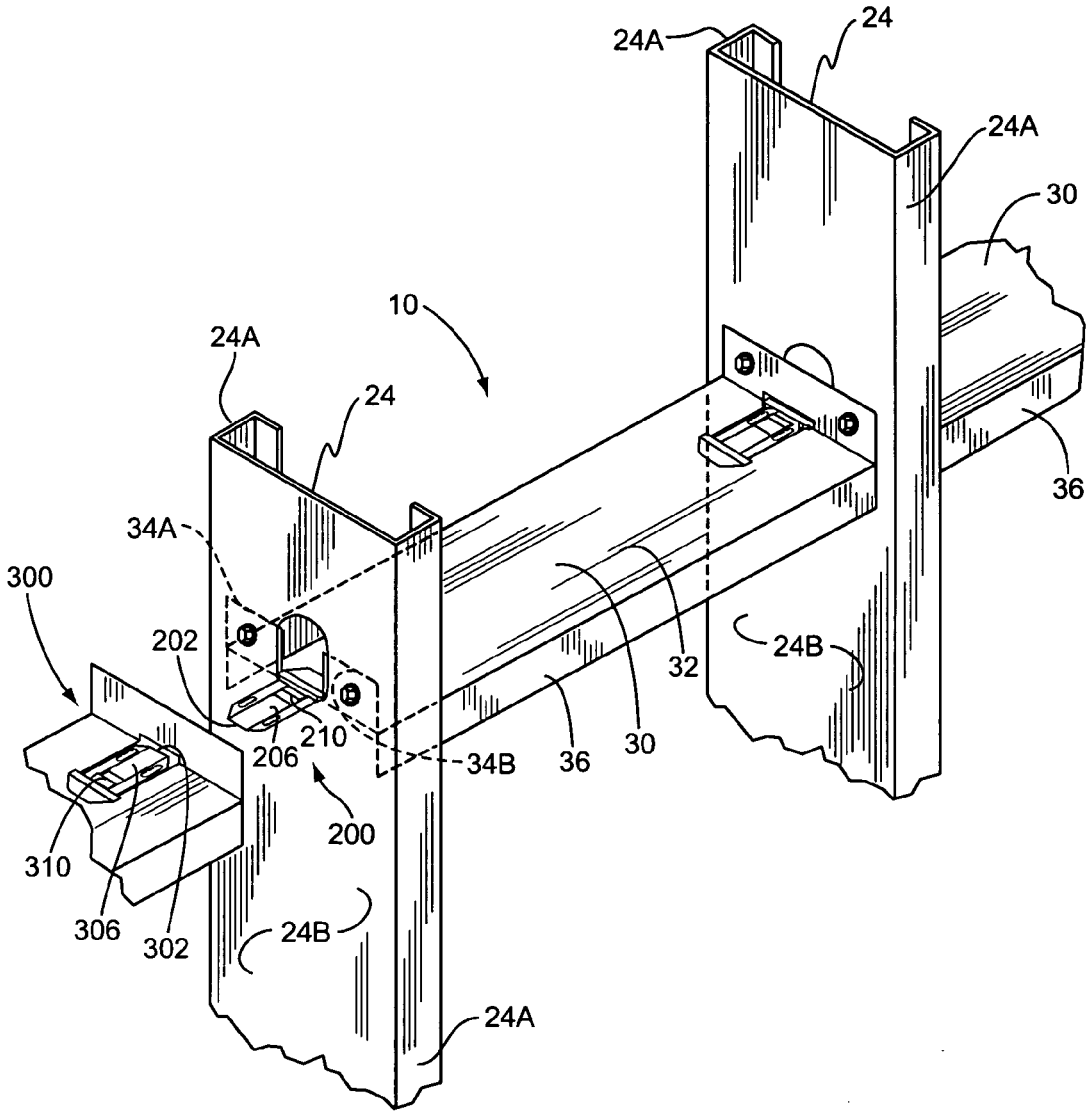
FIG. 6 shows an alternate embodiment for the stud spacer of the present invention and more particularly shows an alternate design for coupling respective stud spacers together.

In the embodiment illustrated in FIGS. 1A-5, the end flanges 34 are turned up about opposite end portions of the stud spacer 10. More particularly in the embodiment shown, the end flanges 34 extend in a plane generally normal to the plane of the central section 30. One of the end flanges 34 extends continuously across the stud spacer 10. However, in this embodiment, the other end flange is divided into sections 34A and 34B. As shown in FIGS. 1A and 3, there is a space or open area that lies between the sections 34A and 34B.

End flanges 34 functions to secure the stud spacer 10 to a pair of spaced apart studs. Accordingly, each end flange including the sections 34A and 34B include an opening for receiving a fastener such as a screw. As will be discussed later, there is provided a series of screws 38 that extend through the openings in the flanges 34 and secure the stud spacer 10 to the web portion of a pair of spaced apart studs.

In addition to the end flanges 34, the stud spacer 10 further includes a pair of side flanges 36. In this embodiment, each side flange 36 is turned downwardly out of the plane of the central section 30. Each side flange 36 lies in a plane that is generally normal to the plane of the central section 30. The side flanges 36, like the ribs 32, strengthen the stud spacer 10.

Each stud spacer 10 is designed such that it can be linked or connected to an adjacent stud spacer. To accommodate this function, the stud spacer 10 is provided with structure that enables the respective stud spacers to be linked or connected end to end when the stud spacers are employed within a wall section 20. In the embodiment illustrated herein, this structure entails a projection 40 that extends from the stud spacer 10. In the design illustrated, the projection 40 is in the form of a turned up tab that is disposed between flange sections 34A and 34B. Note in FIG. 1 where the projection 40 is generally centrally located on the end of stud spacer 10 and projects outwardly past the flange sections 34A and 34B.

About the opposite end portion of the stud spacer 10, there is provided an opening or slot 42. In this case, the opening or slot 42 is dimensioned or sized to receive the projection 40. Thus, when a series of stud spacers are aligned end-to-end and incorporated into a wall section 20, the projection 40 of one stud spacer will project through an opening in an adjacent stud and into the opening or slot 42 of an adjacent stud spacer. Thus, the projection 40, when inserted into the opening 42, effectively connects or at least loosely links one stud spacer to another stud spacer.

Having described the stud spacer 10, it is appropriate now to view how the stud spacer 10 is incorporated into a metal wall section. With reference to FIG. 1, the wall section 20 is a conventional metal wall section except for the stud spacers 10. Wall section 20 would typically include tracks 22. In this case a lower track 22 is shown. In many wall sections there would be a like upper track. In any event, metal studs 24 are connected between the tracks 22 while the tracks are in turn connected to a floor or overhead structure. Studs 24 are conventional metal studs. As such, they include a pair of opposed flanges 24A and a web 24B extending therebetween. An opening 24C is provided in the web 24B of the stud. Studs 24 can be spaced an appropriate distance apart. Extending between each pair of studs is a stud spacer 10. The stud spacer is actually secured to each of the studs that are disposed adjacent opposite end portions of the stud spacer. In this case, the screws 38 extend through openings within the end flanges 34 and actually secure the end flanges 34 and the stud spacer 10 to the web 24B of the adjacent studs 24. Stud spacers 10 are connected between respective spaced apart studs 24 such that the projection 40 from each stud spacer 10 extends through an opening 24C of an adjacent stud 24 and into the opening or slot 42 formed about an end portion of an adjacent stud spacer. That is, the projection 40 of one stud spacer within the wall section 20 extends into an opening or slot 42 of an adjacent stud spacer.

Once secured within the wall section 20, the stud spacers 10 provide rigidity and strength to the entire wall section. More particularly, the stud spacers 10 once incorporated into the wall section 20 discourage bowing or buckling of the studs under the influence of various loads and also tend to prevent the studs 24 from twisting under the influence of side loads or forces.

The stud spacer 10 can be constructed in various lengths and sizes. It is contemplated that the individual stud spaces would be constructed to accommodate conventional stud spacing which is generally 16 and 24 inches. The gauge of metal utilized for the stud spacer 10 can vary. However it is contemplated that the metal used would be in the range of 22 gauge to 16 gauge.

From the foregoing specification and discussion it is appreciated that the stud spacer 10 of the present invention can be easily incorporated into a conventional metal wall. By utilizing the stud spacers 10 of the present invention construction crews can quickly and efficiently erect metal walls that are strong and which will withstand substantial loads and forces from various directions.

Figure 7C:
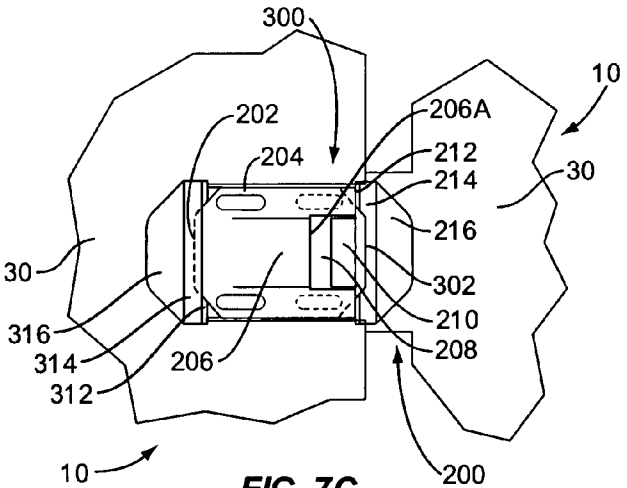
FIGS. 7A-7D are a sequence of plan views illustrating how the stud spacers of the design shown in FIG. 6 are coupled together.
Figure 7D:
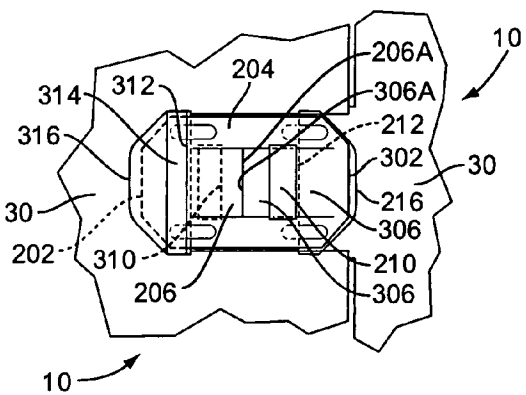
Figure 7A:
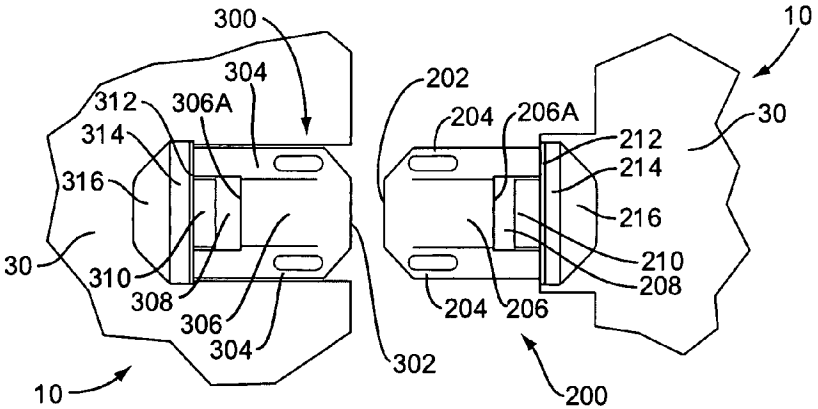
Figure 7B:
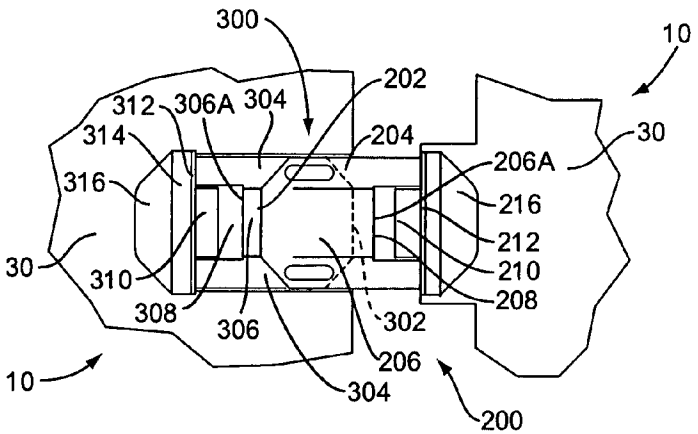

Turning to FIGS. 7A-7H there is shown therein an alternative embodiment for the stud spacer of the present invention. In this embodiment, the stud spacer 10 includes a pair of projections indicated generally by the numerals 200 and 300. That is, each stud spacer includes a projection 200 extending from one end thereof and a projection or projection receiver disposed about the other end. Therefore, it is appreciated that when the respective stud spacers 10 are coupled together, a projection 200 will project from one stud spacer and be coupled to a projection or projection receiver 300 of another stud spacer. As will be seen from the following discussion, the structure or construction of each projection 200 or 300 is similar. Basically one projection will engage the other and the two projections will lock together. As noted above, the elements 200 and 300 are referred to as projections. However, it should be noted that in the particular embodiment illustrated herein that the projection referred to by the numeral 300 can also be simply referred to as a receiver or a projection receiver inasmuch as the same does not actually project outwardly from the main portion of the stud spacer. That is, the projection or receiver 300, as illustrated in FIG. 7A is at least partially surrounded by the structure 30 of the stud spacer.

In any event, first directing attention to projection 200, and particularly FIGS. 7A-7H, the projection 200 includes a terminal end 202. Formed on each side of the projection 200 is a side portion 204. Formed between the side portions 204 is a flap 206. It should be noted that the flap 206 includes a pair of opposed cut lines that at least partially separate the flap 206 from the adjacent side portions 204. This means, of course, that the flap 206 can flex back and forth within the projection 200. Formed about the end of flap 206 is a terminal end 206A.

Figure 7E:
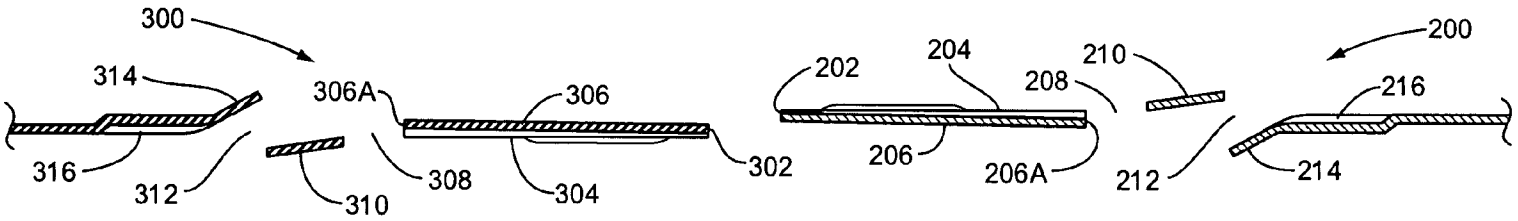
FIGS. 7E-7H are a sequence of sectional views illustrating the projection of one stud spacer being interlocked with a projection or projection receiver of another stud spacer, according to the design shown in FIG. 6.

Formed in the projection 200 adjacent the flap 206 is an opening 208. Disposed adjacent the opening 208 is a hold down element 210. Basically as seen in FIGS. 7E through 7H the hold down element 210 is disposed at an angle and is supported in the projection 200. Disposed adjacent the hold down element 210 is an opening 212. As seen in FIG. 7E opening 212 is disposed between the hold down element 210 and a downwardly directed deflector 214. Disposed above the deflector 214 is a seat 216.

Turning to a discussion of the other projection or receiver 300, this structure includes the same basic structure associated with the projection 200 except that a number of the elements or components of the projection or receiver 300 is disposed in an opposite configuration with respect to the corresponding components of projection 200 to facilitate the interlocking of the structures 200 and 300. In any event, the projection or receiver 300 includes a terminal end 302 and a pair of side portions 304. Disposed between the side portions 304 is a flexible flap 306 that includes a terminal end 306A.

Disposed adjacent the terminal end 306A is an opening 308. Disposed adjacent the opening 308 is a hold down element 310. An opening 312 is defined between the hold down element 310 and an upward directed deflector 314 that includes a seat 316 disposed on the lower side thereof.

Figure 7F:
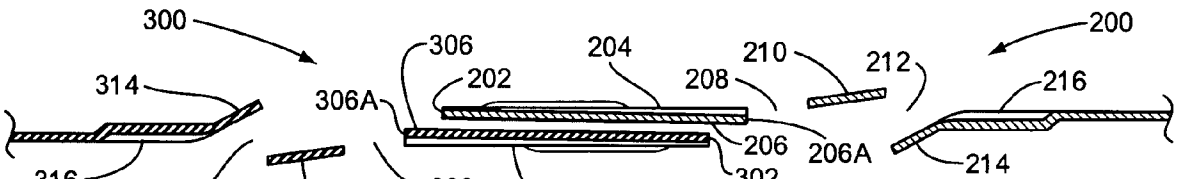
Figure 7G:
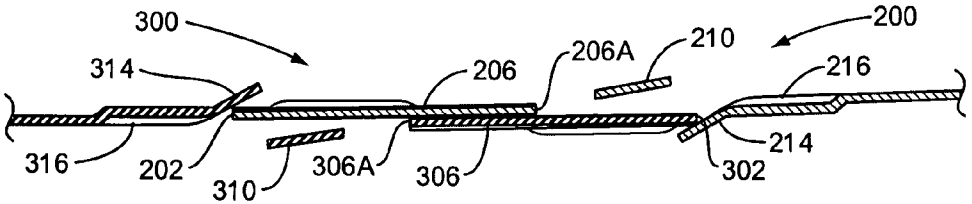

Now turning to FIGS. 7E through 7H an explanation will be set forth illustrating how projections 200 and 300 intermesh or interlock so as to lock two consecutive stud spacers 10 together. As illustrated in FIGS. 7A and 7E, the projections 200 and 300 are disposed in spaced apart relationship and consequently assume an unlocked mode. Note that the projections 200 and 300, in the case of this embodiment are oriented with respect to their respective stud spacers such that the projection 200 is adapted to slide over and interlock with projection or receiver 300. As shown in FIGS. 7E and 7F, projection 200 slides over projection 300. Eventually as shown in FIG. 7G, the terminal end 202 of projection 200 will engage the deflector 314 of receiver 300. Likewise the terminal end 302 of receiver 300 will engage the deflector 214 of the projection 200. By continuing to push the projections 200 and 300 together, the flap 206 will be directed slightly downwardly through the opening 312 in the receiver 300 while the flap 306 will be slightly deflected upwardly through the opening 212 of the projection 200. The continuous pushing of the projections 200 and 300 together will result in the respective flaps 206 and 306 riding up or down the ramps of the deflectors 214 and 314. Eventually the outward portion of flap 206 will come to rest or seat in the seat 316 of the receiver 300. Likewise the outer end portion of flap 306 will come to rest in the seat 216 of the projection 200.

Figure 7H:
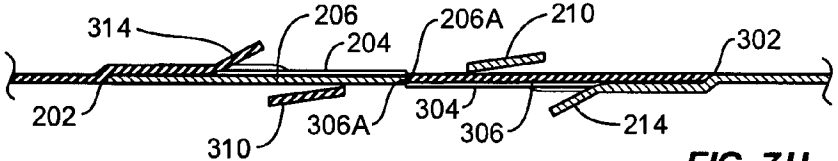

The hold down elements 210 and 310 also function to engage the flaps 206 and 306 and to urge them in an interlocked or locked relationship. More particularly, the hold down clamp 310 will engage the flap 206, as shown in FIG. 7H, and will tend to urge the terminal end 206A of the flap 206 into a position where it engages and abuts against the terminal end 306A of the flap 306. This is illustrated in FIG. 7H. By the same token, the hold down element 210 of projection 200 will tend to engage the flap 306 and cause its terminal end 306A to abuts against the terminal end of 206A of the other flap 206. Thus, as seen in FIG. 7H, the two projections are interlocked and consequently the two stud spacers associated with projections 200 and 300 are interlocked together.

Figure 8:
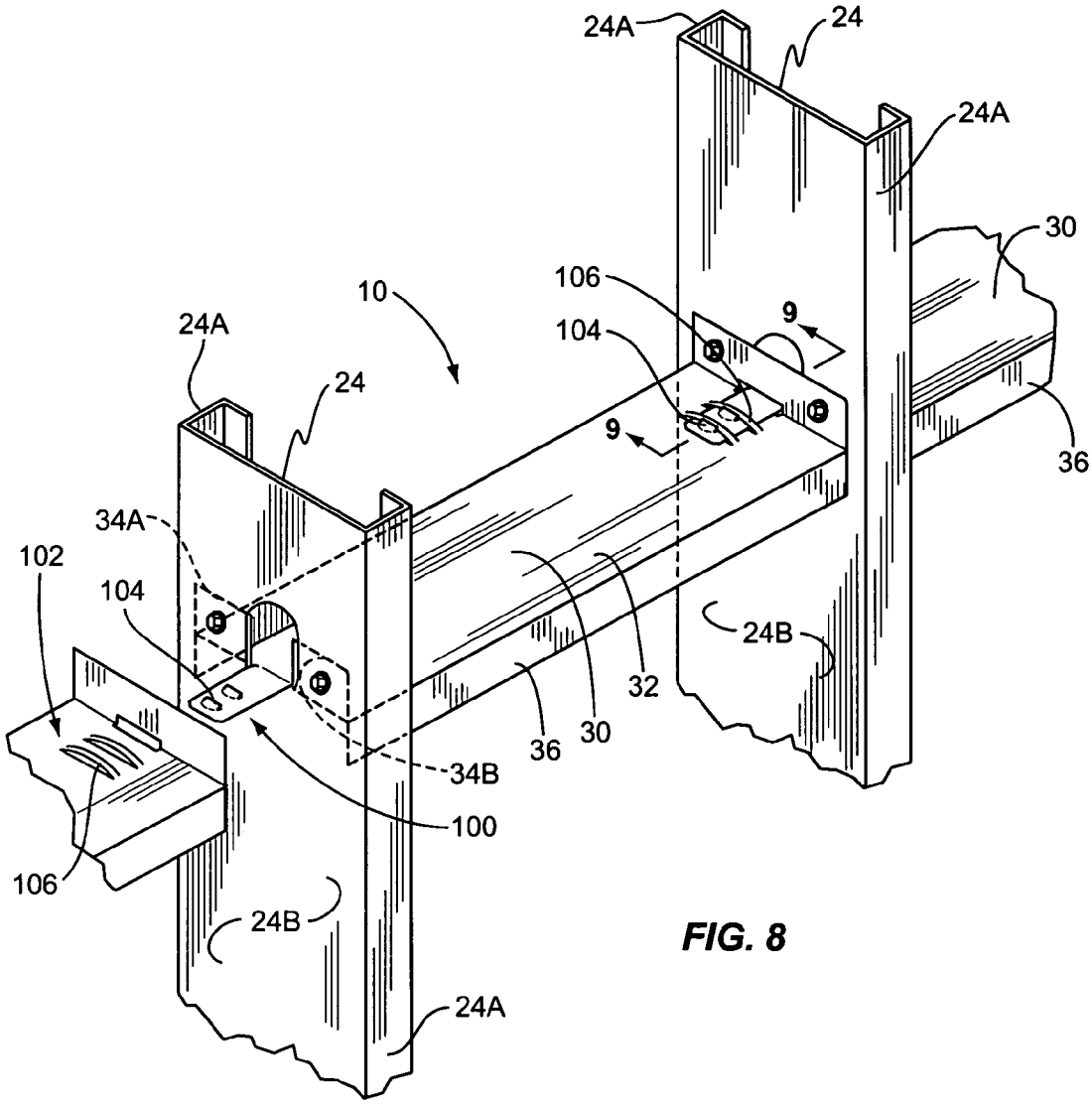
FIG. 8 is a perspective view showing another alternative embodiment for the stud spacer of the present invention.
Figure 9:
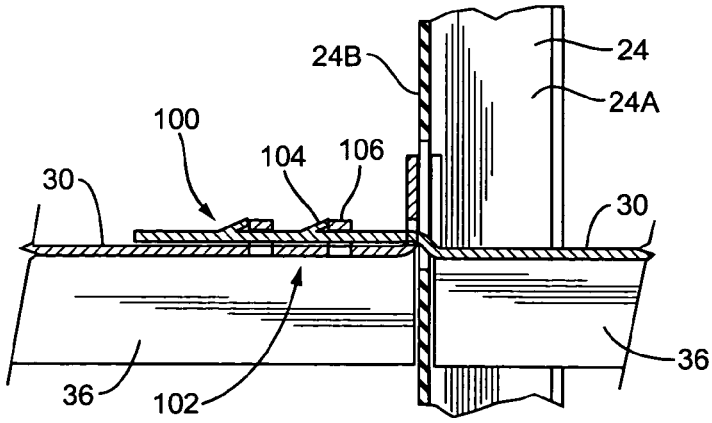
FIG. 9 is a fragmentary sectional view taken through the line 9-9 of FIG. 8.

With reference to FIGS. 8 and 9, an alternate embodiment for the stud spacer 10 of the present invention is shown therein. The embodiment of FIG. 8 includes a coupling arrangement for the stud spacer 10 that differs from the embodiments discussed above. In this case, the stud spacer 10 includes opposed end portions. Formed on one end portion is a projection indicated generally by the numeral 100. Formed on the other end portion of the stud spacer 10 is a projection receiver 102. It will be appreciated that the projection 100 of one stud spacer is adapted to be received and coupled to a projection receiver 102 of another stud spacer.

Viewing projection 100 in more detail, the same include one or more locking members or elements. In the case of the embodiment disclosed in FIGS. 8 and 9, the locking elements include a series of locking tabs 104. Note that the locking tabs 104 are spaced apart and include an upper angled surface that is configured and designed so as to be slightly deflectable or yieldable.

Turning to the projection receiver 102, the projection receiver is formed on the opposite end of the stud spacer 10. Projection receiver 102 includes one or more stops that are designed to engage the locking tabs 104 of a projection 100. In the case of this embodiment, the stops are in the form of raised elements 106. Formed underneath the raised element 106 are openings through which the projection 100 is designed to pass. More particularly, a locking or interlock relationship is realized, as indicated in FIG. 9, by inserting projection 100 underneath the raised elements 106. As the projection 100 is moved or pressed through this area, the upper surface of the angle locking tabs 104 will engage the edges of the raised elements. In the process, the locking tabs 104 will be slightly depressed or deflected enabling them to pass under the raised elements 106. Once the locking tabs 104 have cleared the raised elements 106, the locking tabs will effectively return to their normal position as shown in FIG. 9. Note that the locking tabs 104 in FIG. 9 assume a locked position with respect to the locking elements 106.

Figure 10:
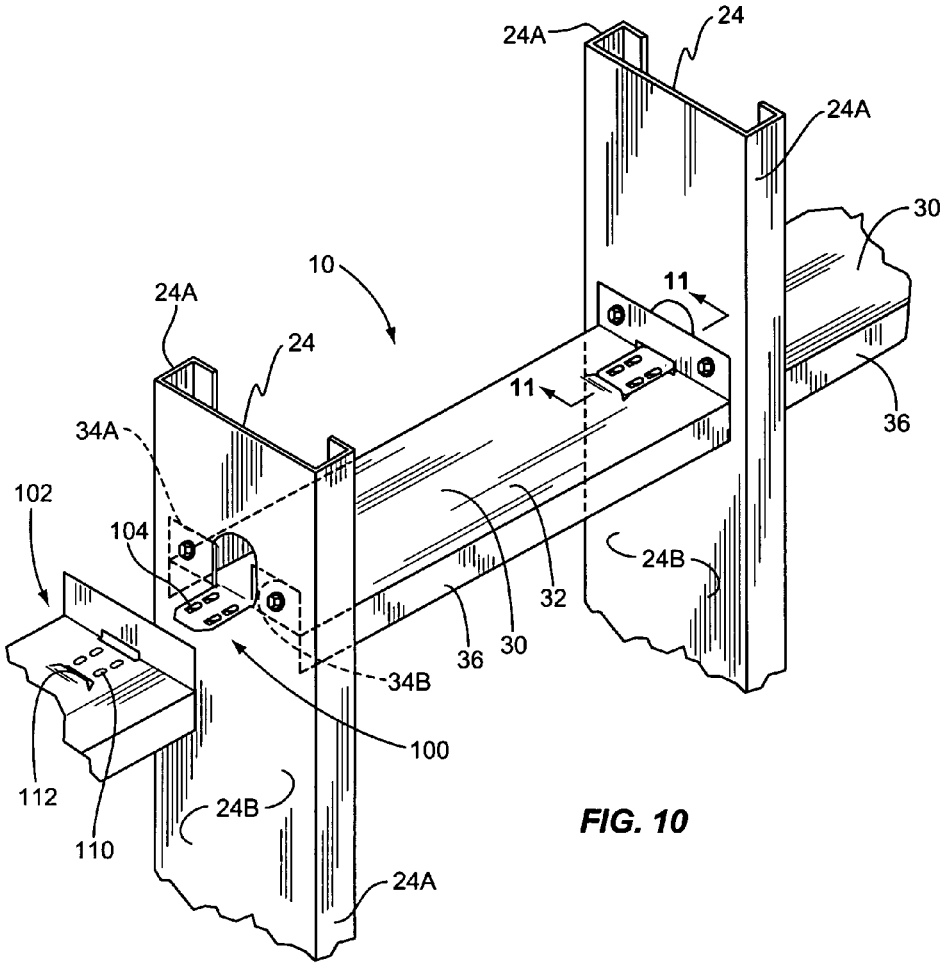
FIG. 10 is a fragmentary perspective view of yet another alternative embodiment for the stud spacer of the present invention.
Figure 11:
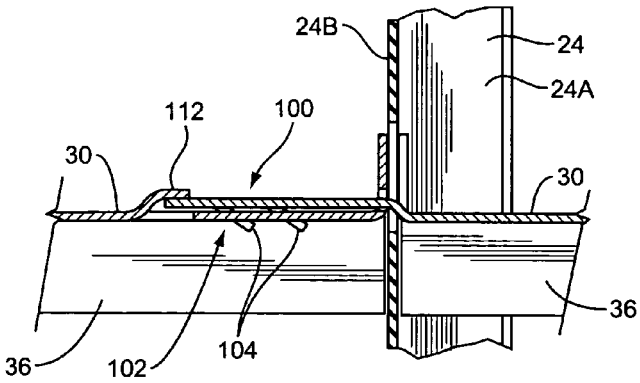
FIG. 11 is a fragmentary sectional view taken through the line 11-11 of FIG. 10.

Turning to FIGS. 10 and 11, another embodiment for the locking structure for the stud spacer 10 is shown therein. In this case, the locking tabs 104 formed in the projection 100 are extended downwardly from the lower surface of the projection 100. Further, the locking tabs 104 are angled, as illustrated in FIG. 11, and are again at least slightly yieldable and flexible. The projection receiver 102 formed in the opposite end of the stud spacer 10 includes a series of openings 110 formed in the opposite end portion of the stud spacer. Disposed adjacent the openings 110 is a retainer 112. When the projection 100 is inserted into the retainer 112, as illustrated in FIG. 11, the locking tabs 104 will snap into or enter the openings 110. Note in FIG. 10 the opening 34C formed in the flange adjacent the projection receiver 102. The opening 34C tends to confine the projection 100 and the cooperation of the retainer 112 and the opening 34C assures that the locking tabs 104 are held within the openings 110 of the projection receiver.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A stud spacer for extending between two studs with each stud having an opening therein, the stud spacer comprising:
- a main member adapted to extend between the two studs;
- the main member including first and second end portions;
- a projection extending from one of the end portions;
- an opening formed in the other end portion;
- wherein the main member includes a pair of side flanges and a pair of end flanges;
- wherein the end flanges are adapted to be connected to the two studs that the stud spacer extends between; and
- wherein the stud spacer is adapted to be connected to another stud spacer by extending the projection of the one stud spacer through the opening within one stud and into the opening of another stud spacer.

2. The stud spacer of claim 1 wherein the main member includes a central section and wherein the side flanges are turned out of the plane of the central section.

3. The stud spacer of claim 2 wherein the end flanges and the side flanges are turned in opposite directions with respect to the central section.

4. The stud spacer of claim 1 wherein at least one end flange is divided into at least two portions and wherein the projection extends between the two portions.

5. The stud spacer of claim 1 wherein the opening formed in the second end portion of the main member includes a slot.

* * * * *